United States Patent [19]

Ibe et al.

[11] 4,300,257

[45] Nov. 17, 1981

[54] APPARATUS FOR CLEANING COKE OVEN DOOR

[75] Inventors: Kazuhiko Ibe; Kenji Fujita, both of Yokosuka, Japan

[73] Assignee: Sumitomo Heavy Industries, Ltd., Tokyo, Japan

[21] Appl. No.: 144,168

[22] Filed: Apr. 25, 1980

[51] Int. Cl.[3] ..... C10B 43/04

[52] U.S. Cl. ..... 15/93 A; 202/241

[58] Field of Search ..... 15/93 A; 202/241

[56] References Cited

U.S. PATENT DOCUMENTS

| | | | |
|---|---|---|---|
| 1,759,014 | 5/1930 | McIntosh | 15/93 A |
| 3,220,038 | 11/1965 | Balitsky et al. | 15/93 A X |
| 3,758,910 | 9/1973 | Lakeberg | 15/93 A |

FOREIGN PATENT DOCUMENTS

| | | | |
|---|---|---|---|
| 2384837 | 11/1978 | France | 15/93 A |

*Primary Examiner*—Edward L. Roberts

*Attorney, Agent, or Firm*—Armstrong, Nikaido, Marmelstein & Kubovcik

[57] ABSTRACT

An apparatus for cleaning surfaces, particularly both vertical surfaces, of a plug of a coke oven door. The apparatus has a pair of rotary scrapers adapted to be moved up and down in contact with both vertical surfaces of the plug. Each rotary scraper incorporates a screw type cutter for a higher cleaning efficiency. In order to facilitate the precise location of the coke oven door in relation to the scrapers, the cleaning apparatus further has a door holding device adapted to receive the coke oven door at a position in front of the scrapers and to convey the same to the cleaning position. Also, the cleaning apparatus has a scraper cleaning device adapted for fitting the spiral groove of each scraper to move along the latter as the scraper is rotated, thereby to remove tar or the like deposits from the spiral groove of the scraper.

10 Claims, 10 Drawing Figures

APPARATUS FOR CLEANING COKE OVEN DOOR

BACKGROUND OF THE INVENTION

The present invention relates to an apparatus for cleaning a coke oven door and, more particularly, to an apparatus for scraping and removing tar, coke or other deposits from the plug portion of the coke oven door projected into the coke oven.

Generally, the coke oven door has a plug portion which is projected into the coke oven during operation of the latter. A large amount of tar, coke or the like contaminants deposits to the side surfaces of the plug portion during operation, so that it is necessary to clean the coke oven door by removing these deposits from the side surfaces of the plug portion of the coke oven door detached from the coke oven. The coke oven door has a large height well reaching several meters and, hence, a considerably large weight. Therefore, conventionally, the coke oven door is detached from the coke oven by means of a specific machine for detaching and attaching the door. The door detaching/attaching machine then conveys the coke oven door to a door cleaning apparatus with which the door is cleaned mechanically while being held by the detaching/attaching machine.

There have been proposed and used various types of cleaning apparatus for mechanically cleaning the coke oven door.

One of the known coke oven door cleaning apparatus has a plurality of tabular scraper blades carried in the form of a train by an endless chain adapted to be driven around the plug portion of the coke oven door keeping the scraper blades in contact with the latter so as to mechanically scrape off the deposits.

Another known cleaning apparatus has a radial cutter type scraper having a plurality of radial plate-shaped scraper blades attached to a rotary shaft and extending in the axial direction of the rotary shaft, the scraper being adapted to be rotated and moved along the side surface of the plug portion of the coke oven door to scrape off the deposits.

These known cleaning apparatus, however, have a drawback that the tar, coke or the like deposits scraped off from the plug portion of the coke oven door are inconveniently deposited and accumulated on the scraper or cutter blades. The tar, coke or the like attaching to the cutter or scraper blades can hardly be removed and considerably deteriorates the efficiency of the cleaning work. The tar component or the like deposits on the plug portion of the coke oven door is soon solidified as the latter is cooled to make the cleaning difficult or materially impossible, thereby resulting in various troubles and failures.

Usually, the coke oven door cleaning apparatus is mounted together with the coke oven door detaching-/attaching machine on a coke pusher machine or a coke-guide trolley adapted to run along a coke oven battery. Conventionally, it has been necessary to correctly locate the coke oven door by the door attaching-/detaching machine, in relation to the cleaning apparatus. Thus, the conventional apparatus require a troublesome preparatory work in advance to the cleaning operation and, in addition, the desired cleaning effect is often failed due to incorrect positioning of the coke oven door in relation to the cleaning apparatus. Further, the coke oven door has been often damaged due to a collision with the cleaning cutter as a result of an erroneous operation of the detaching/attaching machine.

SUMMARY OF THE INVENTION

It is, therefore, a major object of the invention to provide an apparatus for cleaning coke oven door having a scraper which produces much reduced deposition of tar, coke or the like thereon and which can ensure a higher efficiency of the cleaning operation.

It is another object of the invention to provide a coke oven door cleaning apparatus having a device adapted for cooperating with the scraper mentioned above in removing the tar and other contaminants from the scraper in quite easy manner.

It is still another object of the invention to provide a coke oven door cleaning apparatus which can easily and precisely locate the coke oven door, in a predetermined cleaning position.

To these ends, according to the invention, there is provided an apparatus for cleaning a coke oven door comprising: a base; a main frame structure supported by the base to stand upright therefrom; at least one scraper having a screw-type cutter carried by a rotary shaft; a truck mounting the scraper such that the scraper engages the peripheral surface of the plug to be cleaned while maintaining the axis of the scraper horizontally; means for rotatively driving the scraper; means for guiding the truck such that the scraper is moved along the surface to be cleaned; and means for driving the truck along the truck guiding means.

The scraper incorporated in the cleaning apparatus of the invention is provided with a screw-type cutter. Therefore, the tar or the like deposits scraped off from the side surface of the plug portion of the coke oven door is transferred in the axial direction of the cutter as in the case of a screw conveyor, so that the undesirable clogging of the cutter blades is fairly avoided. Before the spiral groove between successive turns of the screw-type cutter becomes clogged with the tar or the like deposits transferred from the coke oven door, the deposits on the screw cutter can be easily removed by rotating the cutter while maintaining a plate-shaped scraper adapted to be moved in the axial direction of the cutter in engagement with the spiral groove of the cutter. Further, the apparatus of the invention can have a heat generating body incorporated in the above-mentioned plate-shaped scraper to heat and melt the deposits which have been solidified and become sticky, thereby to facilitate the removal of these deposits from the screw-type cutter of the scraper.

According to a preferred embodiment of the invention, the coke oven door cleaner has a pair of supporting frames extending forwardly from both front side portions of the main frame structure in parallel with the scraper and in the direction of projection of the scraper. The pair of supporting frames have a coke oven door holding device mounted for free movement in parallel with the scraper and provided with at least one pair of hooks. The door holding device is adapted to wait at an advanced position on the supporting frames for the coke oven door which is conveyed by the coke oven door detaching/attaching machine and to receive the coke oven door by its hooks. Thereafter, the door holding device is retracted to bring the coke oven door to a cleaning position where the scraper can engages the surface of the plug of the coke oven door. Thus, the apparatus of the invention ensures a precise location of the coke oven door while avoiding the collision of the coke oven door with the scraper.

These and other objects, as well as advantageous features of the invention will become more clear from the following description of the preferred embodiments taken in conjunction with the accompanying drawings.

DESCRIPTION OF THE PREFERRED EMBODIMENTS

Figure 1:
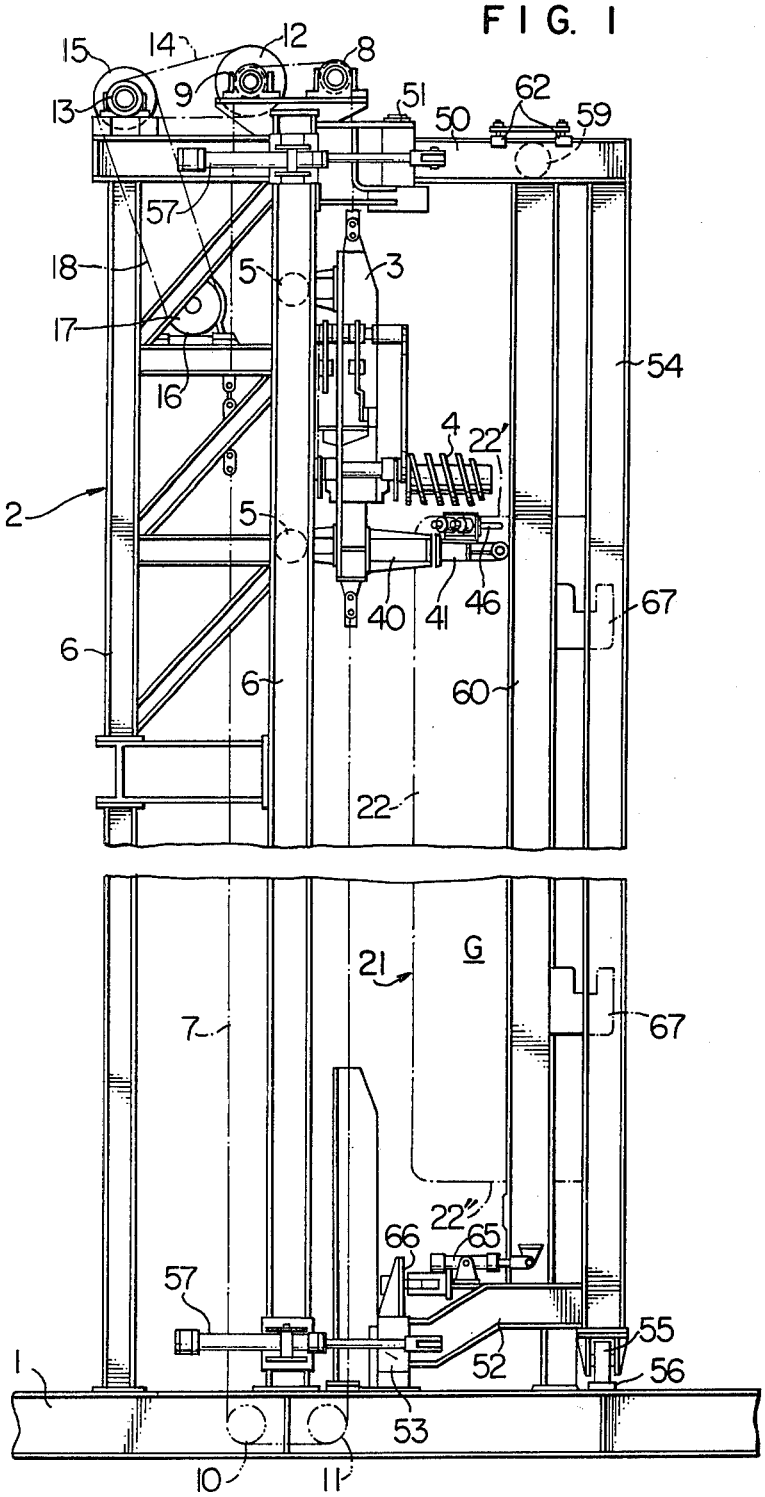
FIGS. 1, 2 and 3 are a side elevational view, front elevational view and a plan view of an embodiment of the invention in which intermediate portion of a main frame structure is neglected from FIGS. 1 and 2.
Figure 2:
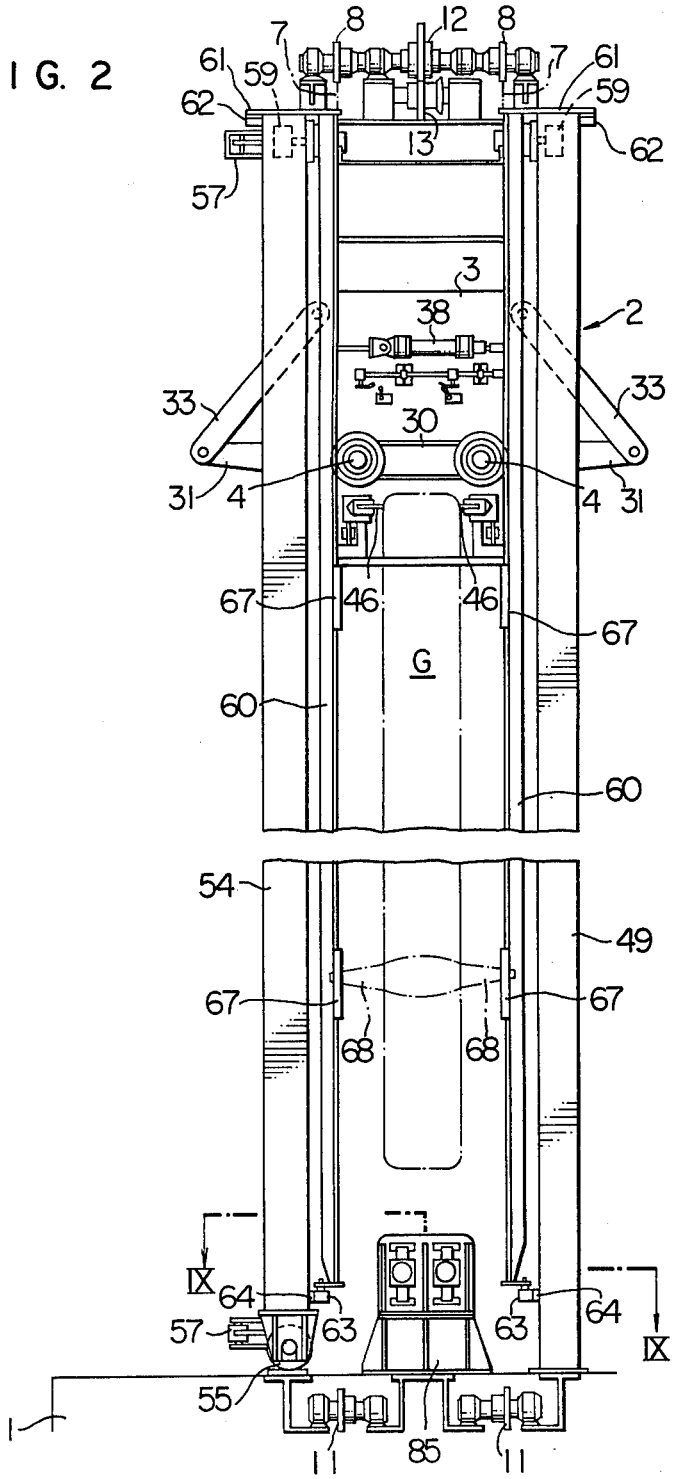

Referring to FIGS. 1 and 2, a reference numeral 1 denotes a base fixed to a coke pusher machine or a coke guide trolley. A main frame structure 2 having a square horizontal cross-section presented by four vertical posts 6 is mounted on the base 1. A truck 3 is adapted to be moved up and down along the front side (right-side as viewed in FIG. 1) of the main frame structure 2. The truck 3 has a pair of rotary scrapers 4 extending forwardly therefrom and in parallel with each other. An upper pair of rollers 5 including a left and right rollers and a lower pair of rollers 5 also including a right and left rollers are mounted on supports extending backwardly from the truck 3 as will be seen from FIG. 4. Each of four vertical posts 6 is constituted by an H-shaped steel, and the aforementioned rollers 5 are adapted to make rolling contact with grooves of two front-side posts 6 to guide the truck 3 moving up and down.

A left and a right chain 7 constituting a pair are connected at their both ends to the upper and lower sides of the truck 3. These chains go round sprockets 8, 9 and sprockets 10, 11 provided at the top and the bottom of the main frame structure 2. A sprocket 12 having a comparatively large diameter is mounted on the rotary shaft of the left and right sprockets 9. A chain 14 is stretched between this sprocket 12 and another sprocket 13 mounted on the top of the main frame structure 2.

A sprocket 15 attached to the shaft of the sprocket 13 is drivingly connected by means of a chain 18 to a sprocket 17 attached to the shaft of a motor 16 mounted on the upper portion of the main frame structure 2. The arrangement is that the truck 3 is moved up and down keeping the rollers 5 in rolling contact with the guide rails constituted by the vertical posts 6, as the motor 16 is energized to rotate its shaft in one or the other direction.

The above truck driving system comprising the combination of chains and sprockets is not exclusive, and can be modified in various ways. For instance, the truck 3 is suspended by means of ropes which are adapted to be wound and unwound by means of drums installed on the top of the main frame structure thereby to lift and lower the truck 3. It is also possible to arrange such that the truck 3 is moved up and down by means of a combination of hydraulic cylinders and links, a hoist, or rack and pinion and so on.

Figure 4:
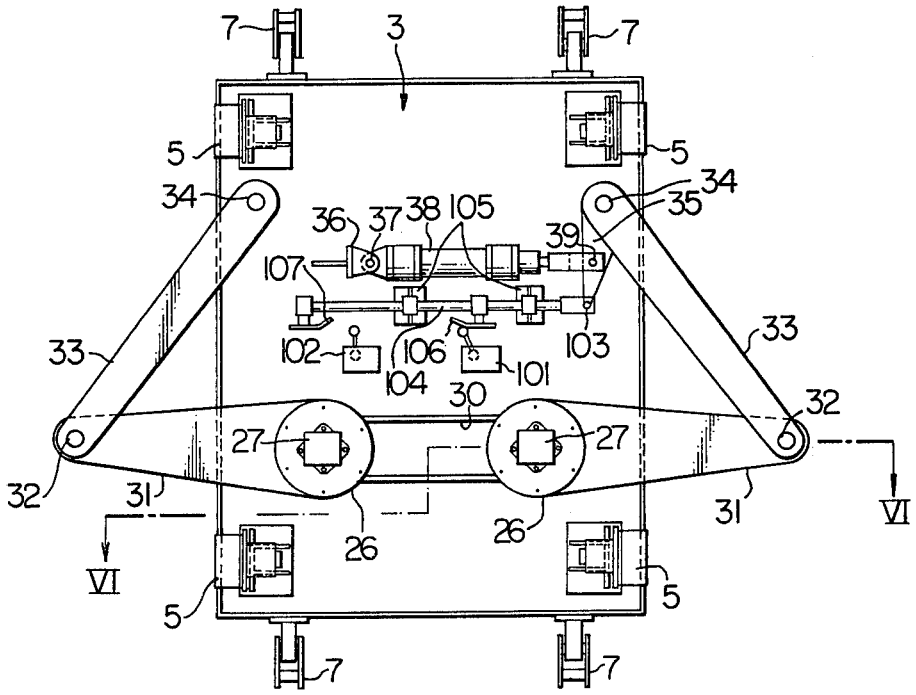
FIGS. 4 and 5 are a rear elevational view and a side elevational view of a truck carrying a scraper shown in FIGS. 1 to 3.
Figure 5:
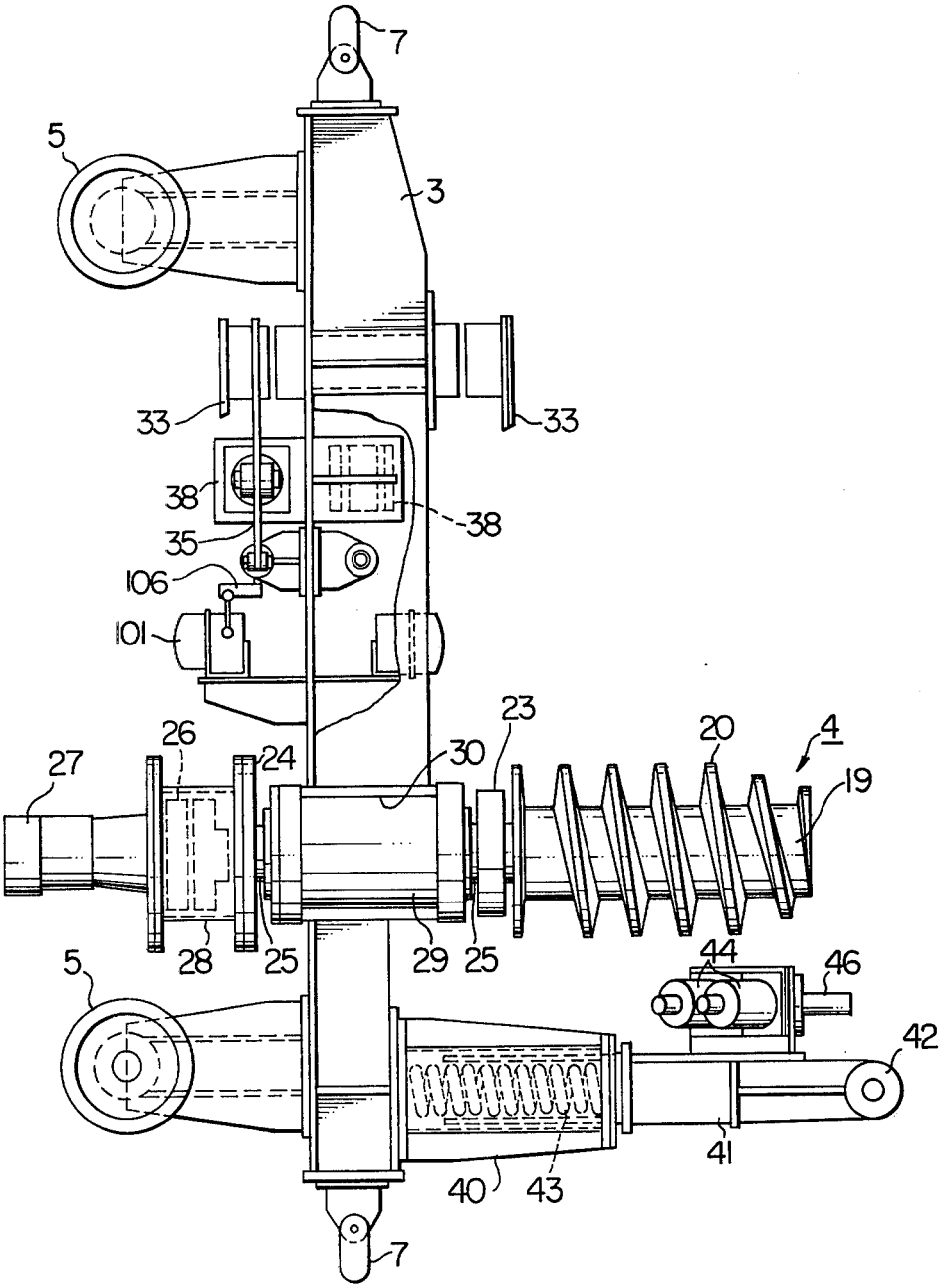
Figure 6:
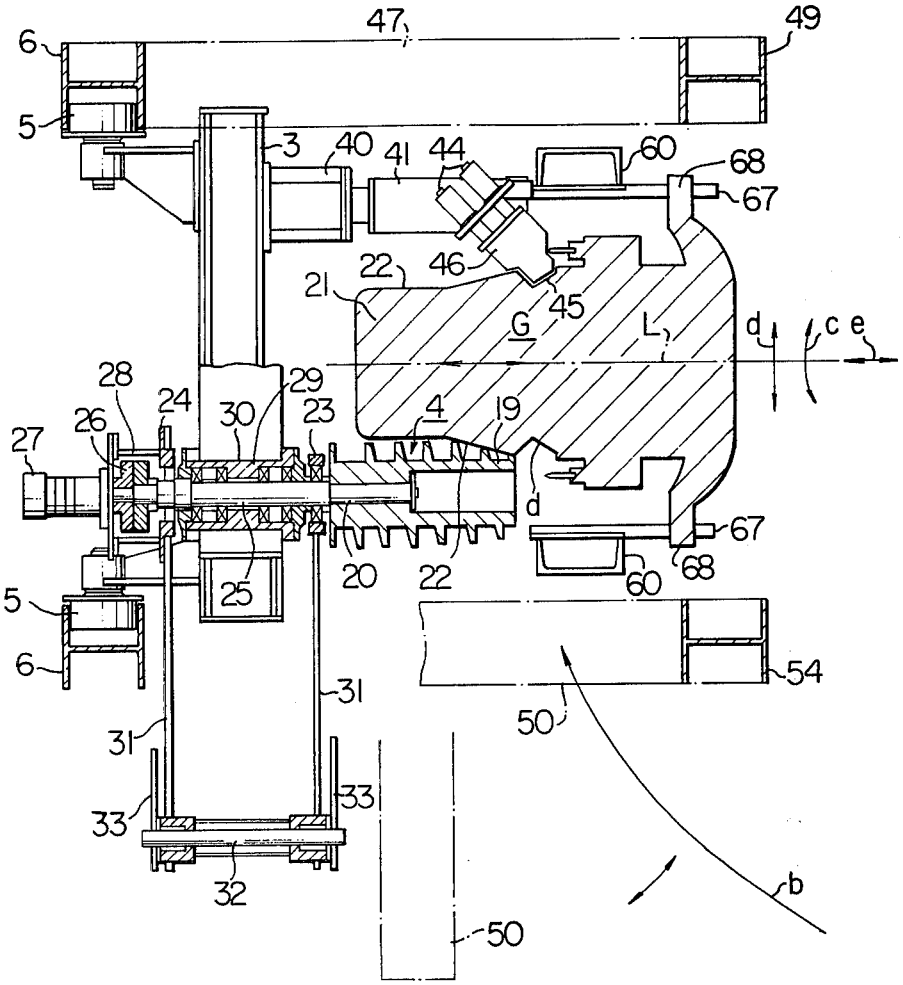
FIG. 6 is a sectional view of the truck taken along the line VI—VI of FIG. 4 and shows how the scraper blades are engaged with the plug and groove of a coke oven door.

As shown in detail in FIG. 5, the scraper 4 has a cylindrical shaft 19 around which formed is a screw-type cutter 20 and has a configuration matching the profile of the side surface 22 of the plug 21 of the coke oven door G to be cleaned, as will be seen from FIG. 6. The scraper 4 is attached to the front end of a rotary shaft 25 which is rotatably supported by bearings mounted in a front and a rear supporting rings 23, 24. The shaft 25 is connected at its rear end to the shaft of a motor 27 through a coupling 26. The motor 27 is fixed to a rear end wall of an annular casing 28 which in turn is fixed to the rear ring 24 to surround the coupling 26. Preferably, a hydraulic motor which can vary rotational speed and torque over wide ranges in response to a change in the load is used as the motor 27. A roller 29 is attached to the portion of the rotary shaft 25 between the rings 23 and 24 through the medium of a bearing. The roller 29 is adapted to roll within a guide slot 30 which extends horizontally through the truck 3. Thus, the scraper 4 is carried by the truck 3 for transverse movement. Levers 31, 31 are connected at their one ends to the rings 23, 24 while the other ends of these levers are pivotally secured to one ends of another levers 33, 33 through pins 32. Other ends of the levers 33, 33 are pivoted to the truck 3 by means of pins 34, as shown in FIG. 4.

Referring now to FIG. 4, the right lever 33 attached to the rear side of the truck 3 has a short lever 35 unitary therewith and adapted for rotating around the pin 34, whereas the left lever 33 attached to the front side of the truck 3 has a similar short lever 35 which is not shown. Hydraulic cylinders 38 pivotally connected at 37 to brackets 36 on the rear and front sides of the truck 3 (only the hydraulic cylinder 38 connected to the rear side of the truck 3 is shown) have piston rods the ends of which are pivoted at 39 to the short levers 35. The arrangement is such that, as the hydraulic cylinders 38 are energized, the rollers 29 roll in the guide slots 30 to permit the scraper 4 to move transversely of the truck 3.

As detailed in FIGS. 5 and 6, the truck 3 further has brackets 40 extending forwardly therefrom to underlie respective scrapers 4. A mounting base 41 is supported by the brackets 40 for movement in parallel with the scraper 4. The mounting base 41 is provided at its front end with a roller 42 and is biased forwardly by means of a spring 43. Two cylinders 44 are mounted on the mounting base 41 so as to extend in parallel with each other. These cylinders 44 are inclined inwardly with respect to the axis of the scraper 4. A plate-shaped scraper 46 is attached to the ends of the piston rods of the cylinders 44 so as to clean groove 45 provided at the base portion of the plug 21 of the coke oven door G. A spring (not shown) for forwardly biasing the piston is provided in each cylinder 44. As the scraper 4 is placed along the side surface 22 of the plug 21 of the coke oven door 21, the plate-shaped scraper 46 is pressed by the springs into the groove 45 to fit the wall of the groove as will be seen from FIG. 6.

Referring again to FIGS. 1, 2 and 3, one of two front vertical posts 6 which together with two rear vertical posts 6 constitute the main frame structure 2 is provided with a long girder 47 extending forwardly and horizontally, while the other of two front vertical posts 6 is provided with a short girder 48 extending also forwardly and horizontally. The end of the girder 47 is fixed to another vertical post 49 standing up from the base 1, while the end of the girder 48 pivotally carries at 51 an upper arm 50 which is adapted to rock within a horizontal plane.

A lower arm 52 is mounted immediately above the base 1 so as to extend in parallel with the upper arm 50. Between the lower portion of the vertical post 6 carrying the girder 47 and the vertical post 49 carrying the same girder, is connected another horizontal girder 47' so as to oppose to the lower arm 52, as will be seen from FIG. 9. The lower arm 52 is fixed at its rear end to a boss 53 which is rotatably fitted to a stud formed on the base 1 coaxially with the pivot shaft 51 of the upper arm 50. Thus, the lower arm 50 is swingable as in the case of the upper arm 50. A vertical girder 54 is fixed at its upper and lower ends to the front ends of the upper and lower arms 50, 52. A roller 55 is attached to the lower end of the vertical girder 54 and is adapted to roll along a rail 56 laid on the base 1 and having an arcuate form centered at the axis of the boss 53. Two hydraulic cylinders 57 are connected to an upper and lower portions of the front vertical post 6 at the same side as the upper and lower arms 50, 52. These hydraulic cylinders have piston rods whose ends are pivoted to the end of levers 58 swingable unitarily with the upper and lower arms 50 and 52. The arrangement is such that the supporting frame constituted by the upper arm 50, lower arm 52 and the vertical girder 54 rocks or swings around the axis of the boss 53 and the pivot shaft 51 between positions shown by solid line and by one-dot-and-dash line in FIG. 3 as represented by a double-line arrow a, as the cylinders 57 are actuated.

The horizontal girder 47 and the upper arm 50 are constituted by an H-shaped steel. A pair of movable vertical girders 60 each having a roller 59 adapted to roll along the inner groove of the H-shaped steel, 47 or 50 are suspended by the rollers 59 so as to extend in parallel with the vertical post 49 and the vertical girder 54. A bracket 61 is fixed to the top end of each movable girder 60. A pair of rollers 62 having vertical axis of rotation are attached to the bracket 61 and adapted to roll in contact with the upper outer edge of the H-shaped steel constituting the horizontal girder 47 or the upper arm 50. Also, a roller 63 having a vertical axis of rotation is attached to the lower end of the movable vertical girder 60 and is adapted to roll along a horizontal rail 64 laid on the inside of the lower arm 52 or the lower horizontal girder 47'. Each movable vertical girder 60 is adapted to be moved by operation of a hydraulic cylinder 65 while keeping a vertical posture parallel to the vertical post 49 and the vertical girder 54.

FIG. 1 shows only the hydraulic cylinder 65 for driving the movable vertical girder suspended from the upper arm 50. This hydraulic cylinder is attached to the bracket 66 fixed to the boss 53 of the lower arm 52. Each movable vertical girder 60 is provided with two hooks 67 at its upper and lower portions at selected heights.

The coke oven door cleaning apparatus of this embodiment having the construction heretofore described operates in a manner described hereinunder.

Before receiving the coke oven door G, the hydraulic cylinders 65 are energized to place the movable vertical girders 60 at the most advanced positions. Then, the hydraulic cylinders 57 are operated to station the supporting frame constituted by the upper and lower arms 50, 52 and the vertical girder 54 at an outwardly opened posture substantially at a right angle to the horizontal girder 48, as shown by one-dot-and-dash line in FIGS. 3 and 6.

The coke oven door G held by the door detaching-/attaching machine (not shown) is finally swung as shown by an arrow b in FIG. 6 and moved to a position in front of the scraper 4. Subsequently, the hydraulic cylinders 57 are energized to bring the supporting frame 50, 52, 54 to a position aligning with the horizontal beam 48 as shown by full line in FIG. 3. Thereafter, the coke oven door G held by the detaching/attaching machine is lowered slightly by a manual control of the operator to bring the ends of two horizontal bars 68 attached to the front surface of the door G into engagement with the hooks 67 of the movable vertical girders 60.

Figure 3:
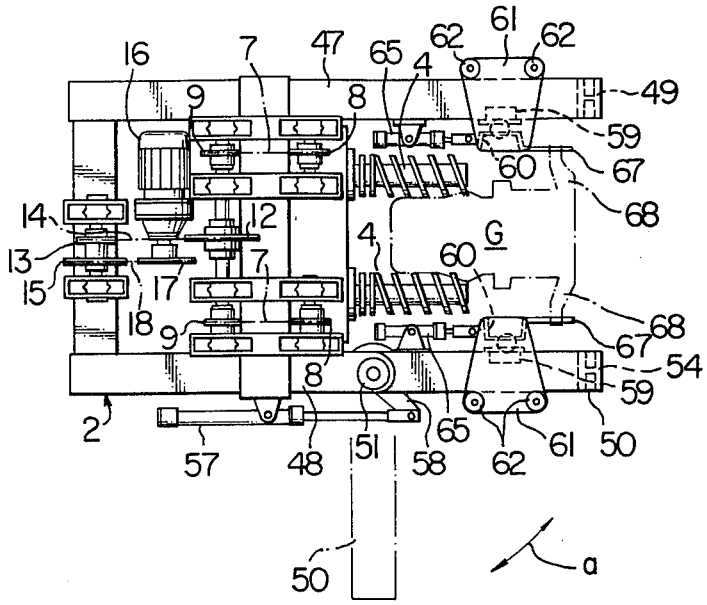

The coke oven door G thus transferred from the detaching/attaching machine to the cleaning apparatus is held by the latter in such a manner that its longidudinal axis L extends precisely in parallel with the axes of the scrapers 4 and that the left and right side surfaces of the plug 21 are maintained correctly vertically. Then, the hydraulic cylinders 65 are energized to retract the movable girders 60 toward the truck 3 to bring the coke oven door G to a position where the plug 21 of the door G is positioned between two scrapers 4 as shown in FIG. 3. As the coke oven door G is conveyed to this position, the roller 42 on each mounting base 41 attached to the lower side of the truck 3 comes to be resiliently pressed against the movable girder 60 and the plate-shaped scraper 46 fits into the groove 45 of the coke oven door G. The positions of two scrapers 4 are previously adjusted by the hydraulic cylinders 38 such that these scrapers are spaced away from the side surfaces of the plug 21 to be cleaned in this state. Also, the truck 3 is positioned such that two scrapers 4 are stationed at the lower or upper ends of the side surfaces 22 of the plug 21 to be cleaned.

Subsequently, the hydraulic cylinders 38 are energized to move the scrapers 4 laterally and inwardly until the scrapers 4 contact the side surfaces of the plug 21 at a suitable contact pressure.

Then, as the motors 27 are started to rotatively drive the scrapers 4 and, at the same time, the motor 17 is started to drive the sprocket 9 through the sprocket 16, chain 18, sprocket 15, sprocket 13, chain 14 and the sprocket 12 to drive the chains 7 going round the sprockets 8, 9, 10 and 11, thereby to move the truck 3 up or down. In consequence, the scrapers 4 are moved up or down along the side surfaces 22 of the plug 21 while being rotated by the motors 27 to cut and scrape off the deposits from the side surfaces 22 of the plug 21. At the same time, the plate-shaped scraper 46 fitting in the groove 45 of the coke oven door G scrapes off the deposits from the groove 45.

Usually, another scraper is used for cleaning the upper surface 22' and the lower surface 22'' of the plug 21 of the coke oven door G. According to the described embodiment, however, it is possible to clean the upper and lower surfaces 22', 22" by making use of the scrapers 4 for cleaning the side surfaces 22. To this end, the truck 3 is lifted or lowered to a level which permits the upper surface 22' or lower surface 22" of the plug 21 to be contacted by the scraper 4. Then, while rotating two scrapers 4, one of these scrapers is moved laterally inwardly to a position beyond the center of the upper or lower surface 22' or 22" by the operation of the associated hydraulic cylinders 38. Then, the scraper 4 is moved toward the outside to the original position. Subsequently, the other scraper is reciprocatingly moved in the same manner along the upper or lower surface 22', 22" of the plug to clean the remainder portion of that surface.

In order to prevent the mutual interference between two scrapers 4, limit switches are provided for limiting the stroke of the inward and outward lateral movements of each scraper 4, so that the scrapers may be automatically returned as they reach the stroke ends.

More specifically, referring to FIG. 4, reference numerals 101 and 102 denote limit switches for limiting the inward and outward movement of the scraper 4. A rod 104 pivoted at its one end to the lever 35 as at 103 is supported horizontally by means of two bearings 105 fixed to the truck 3. Two strikers 106 and 107 attached to the rod 104 are adapted to cooperate with the limit switches in a manner explained below. As one of the scrapers 4 (right-side scraper as viewed in FIG. 4) is moved laterally inwardly, the rod 104 is also moved to the left as viewed in FIG. 4 and, when the scraper 4 has moved slightly beyond the breadthwise center of the truck 3, the striker 106 comes to abut the limit switch 101. The limit switch 101 then produces a signal for reversing the hydraulic cylinder 38 to move the scraper 4 in the returning direction, i.e. outwardly. In consequence, the rod 104 is moved to the right until the other striker 107 comes to abut the corresponding limit switch 102 to stop the scraper 4.

In the described embodiment of the invention, the setting of the coke oven door G in the cleaning apparatus is made by swinging the door G from one side of the cleaning apparatus as shown by arrow b in FIG. 6, by means of the detaching/attaching apparatus. Due to a restriction concerning the layout of the detaching/attaching machine and the cleaning apparatus on the coke pusher machine or the coke guide trolley, in some cases the coke oven door has to be conveyed swingingly from either side of the cleaning apparatus as shown by an arrow c or linearly from either side of the same as shown by an arrow d. In such a case, it is necessary to construct the supporting frame of door holding device at the same side as the horizontal girder 47 outwardly swingably as in the case of the supporting frame of the same side as the horizontal girder 48. However, if the arrangement is made to permit the convey of the coke oven door G linearly from the front side of the cleaning apparatus as shown by an arrow e, the supporting frame of the same side as the horizontal girder 48 may be fixed immovably.

Anyway, in the described embodiment, the coke oven door can easily and precisely be located with respect to the scrapers and various accidents due to collision between the coke oven door and the scraper is avoided, because of the provision of the door holding hooks 62 on the cleaning apparatus itself so that the coke oven door is transferred from the detaching/attaching machine at a position ahead of the scrapers and then moved into the cleaning position.

Figure 7:
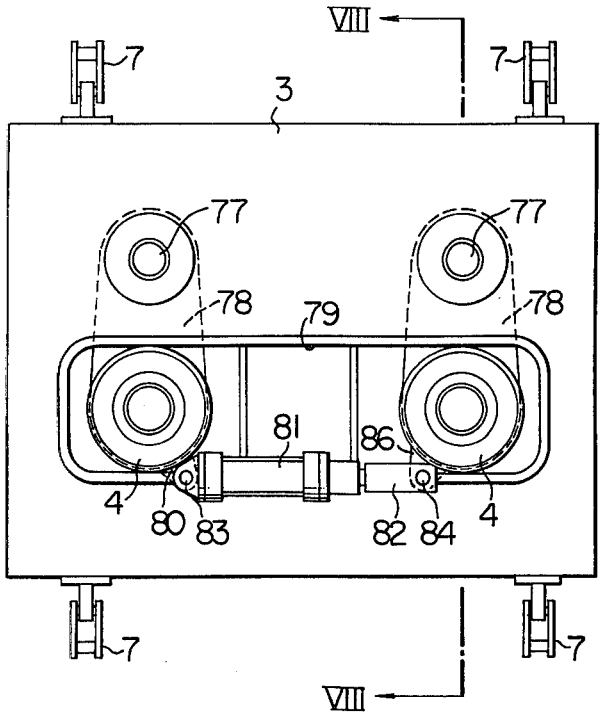
FIG. 7 is a front elevational view of another example of the truck having a different way of mounting of the scraper shown in FIG. 4.
Figure 8:
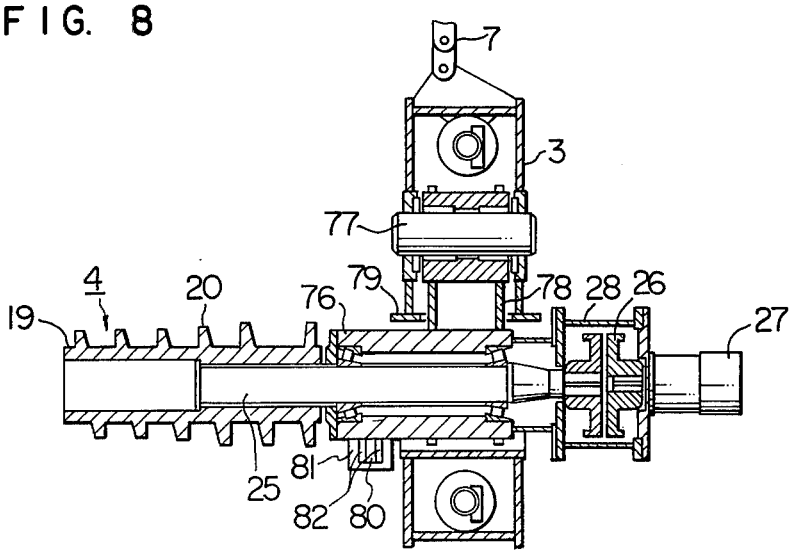
FIG. 8 is a sectional view taken along the line VIII—VIII of FIG. 7.

FIGS. 7 and 8 show another embodiment having a different form of mounting of the two scrapers 4 on the truck 3. As in the case of the embodiment shown in FIGS. 1 to 6, the rotary shaft 25 of each scraper is connected to the motor 27 through a coupling 26. In this embodiment, however, the casing 28 mounting the motor 27 and surrounding the coupling 26 is attached to the bearing body 76 supporting the rotary shaft 25. The bearing body 76 is fixed to one end of the arm 78 which in turn is swingably supported on the truck 3 by means of a pin 77 which extends in parallel with the scraper 4. The scraper assembly including the bearing body 76 extends through a laterally elongated opening 79 formed in the truck 3 with a marging large enough to permit the assembly to make an arcuate movement around the axis of the pin 77.

A bracket 80 is fixed to the lower side of the portion of each of two bearing bodies 76 porjected forwardly from the truck 3. To these brackets 80 connected pivotally is the rear end of a hydraulic cylinder 81 and a fork end 82 attached to the end of a piston rod of the hydraulic cylinder 81, by means of pivot pins 83 and 84. In this embodiment, before locating the plug 21 of the coke oven door G between two scrapers 4, the distance between two scrapers are widened by means of the hydraulic cylinder 81 and, after locating the coke oven door G, the scrapers 4 are moved toward each other to make contact with respective side surfaces 22 of the plug 21 at a suitable contact pressure. The rotation of two scrapers 4 and up and downward movement of the truck 3 are performed in the same manner as the first embodiment shown in FIGS. 1 to 6.

The cleaing apparatus of this embodiment, although it cannot clean the upper and lower surfaces 22', 22" of the plug 21 of the coke oven door G, the scrapers can be controlled by a single hydraulic cylinder and guide rolls for lateral movement of the scrapers are dispensed with. Thus, the cleaning apparatus of this embodiment can have a simplified construction of the mechanism for causing the lateral movement of the scrapers.

Figure 10:
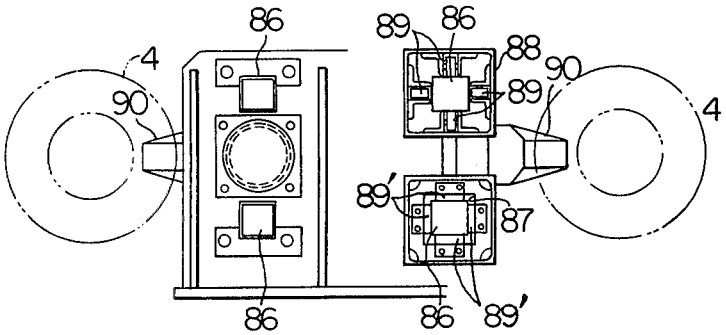
FIG. 10 is a sectional view taken along the line X—X of FIG. 9.

Further, the scraper incorporated in the cleaning apparatus of the invention having a screw-type cutter offers an advantage that the tar or the like deposits on the scraper can easily be removed. FIG. 2 shows a cleaning device for cleaning the scraper and disposed on the base 1 beneath the truck 3. The detail of this scraper cleaning device will be described in detail hereinunder with specific reference to FIGS. 9 and 10. Four guide rods 86 having a square cross-section and disposed between two scrapers 4 and extending in parallel with the latter are connected at their both ends to two brackets 85 which are attached on the base 1 at a suitable distance from each other. The four guide rods are arranged in pairs, the left pair including two guide rods spaced from each other in the vertical direction and the right pair including two guide rods also spaced from each other in the vertical direction. A slider 88 is provided in its each end wall with two square openings 87 for receiving the upper and lower guide rods of each pair. Each slider 88 is internally provided with eight rollers 89 at each of front and rear sides thereof, for making rolling contact with four surfaces of upper and lower guide rods extending therethrough. Each slider 88 is provided with scraper plates 89' disposed at four sides of each square opening 87 and adapted for making contact with four surfaces of the guide rod 86. Each slider 88 is further provided with a secondary scraper 90 extending outwardly from a heightwise mid portion thereof. The secondary scraper 90 is preferably provided with a heat generating body 91 therein. A reference numeral 92 denotes lead wires for supplying electric current to the heat generating body 91. The heat generating body 91 is preferably an assenbly having a sheath heater cast in aluminum or iron case body. Each one of two stoppers 93 carried by each one of brackets 85 is positioned between the upper and lower guide rods and adapted to move in parallel with the guide rods. Each stopper 93 is biased toward the slider 88 by means of a spring 94.

Figure 9:
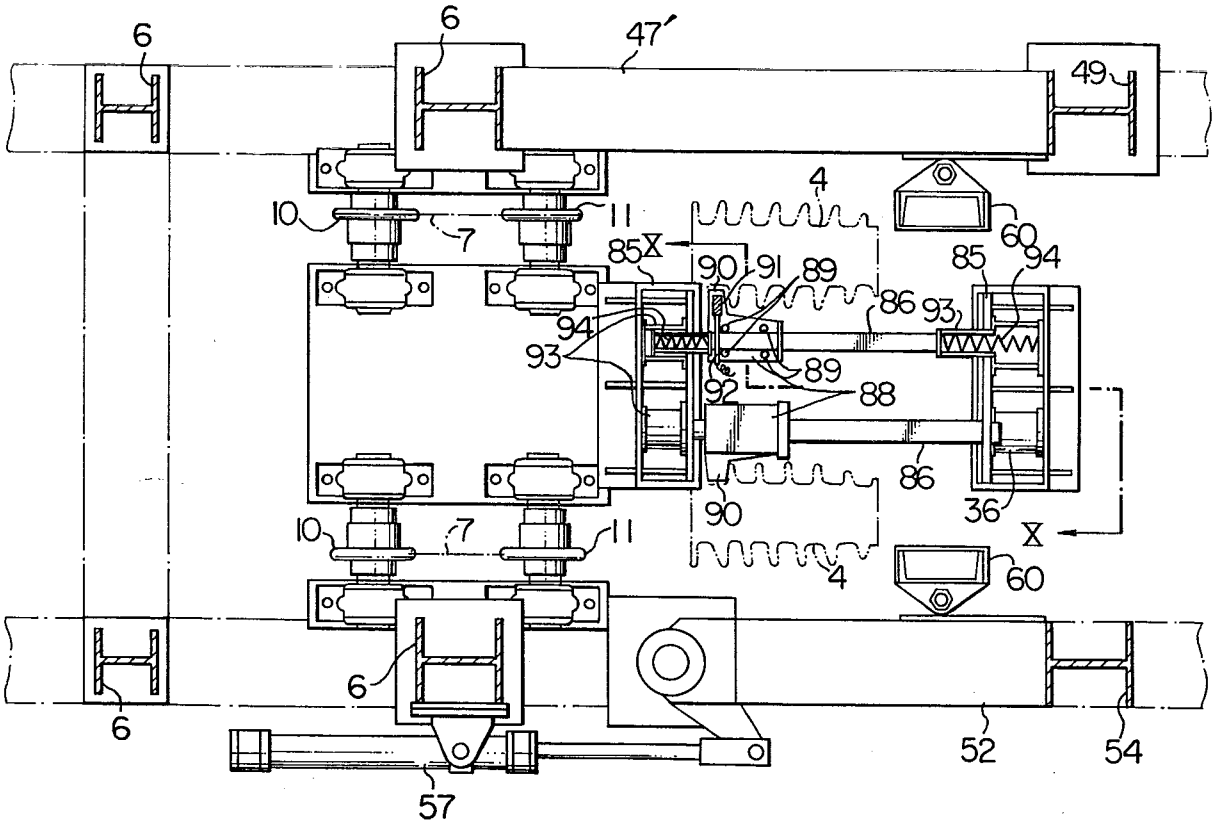
FIG. 9 is a sectional view taken along the line IX—IX of FIG. 2 and shows in a larger scale the detail of a scraper cleaning device.

The screw type scraper cleaning device having the described construction operates in a manner explained hereinunder. When the cleaning efficiency has come down due to a deposition of tar or the like on the scrapers 4, the truck 3 is lowered to the lowermost position as shown in FIG. 2 to bring the scraper 90 of the slider 88 into engagement with the groove of the scraper 4 as shown in FIG. 9. Subsequently, the motor 27 is started to rotate the scraper 4 so that the secondary scraper 90 slides along the spiral groove of the scraper 4 and moves in one direction linearly along the guide rods 86.

As the secondary scraper 90 has reached near one end of the scraper 4, the slider 88 is made to contact at its one end with the stopper 93 to move the latter back overcoming the force of the spring 94. The slider 88 is stopped when the secondary scraper 90 has completely moved beyond one end of the scraper 4.

Subsequently, the motor 27 is reversed to drive the slider 88 in the reverse direction. The secondary scraper 90, which has been temporarily disengaged from the spiral groove of the scraper 4, is brought back into engagement with the spiral groove as the scraper 4 starts to rotate in the reverse direction, because the slider 88 is pressed back by the action of the spring 94 provided on the stopper 93, and is then moved in the reverse direction linearly along the spiral groove.

It will be understood that the tar or the like deposits attaching to the spiral groove of the scraper 4 are completely removed from the latter as the secondary scraper 90 of the scraper cleaning device is moved linearly along the spiral groove in accordance with the rotation of the secondary scraper 90. The scraper plates 89' attached to the slider 88 scrape off the tar or the like deposits from the guide rod 86 to ensure a smooth movement of the slider 88. In the event that the tar or the like deposits on the scraper 4 has become solidified or sticky, the heat generating body 91 in the secondary scraper 90 is energized to heat the secondary scraper 90 to heat the secondary scraper 90 to melt the deposits to facilitate the removal of the latter.

As has been described, according to the invention, the scraping effect, i.e. the cleaning effect is very much enhanced due to the use of the screw type cutter blade. In addition, a high cleaning efficiency of the cleaning scraper is maintained for a long time, because the deposition of the tar or the like on the scraper is suppressed thanks to the use of the screw type cutter which performs an action like a screw conveyor to automatically convey in the axial direction the tar or the like separated from the coke oven door. Further, the tar or the like transferred from the coke oven door to the scraper can easily be removed from the latter by the scraper cleaning device.

In the described embodiments, two scrapers are mounted on a single truck to clean both side surfaces of the plug of the coke oven door at a time. This is not excusive and the cleaning apparatus of the invention can have only one scraper adapted to move around the surfaces of the plug while rotating around its own axis. The use of two scrapers, however, offers an avantage that the centering or positioning of the coke oven door can be considerably facilitated by the two scrapers which cooperate with each other in clamping the coke oven door therebetween.

Although the invention has been described through its preferred forms, it should be noted here that the described embodiments are only illustrative and various changes and modifications may be imparted thereto without departing from the scope of the invention which is limited solely by the appended claims.

What is claimed is:

1. An apparatus for cleaing a coke oven door having at its back side a plug adapted to be projected into the coke oven comprising: a base; a main frame structure supported by said base to stand upright therefrom; at least one scraper having a screw-type cutter carried by a rotary shaft; a truck mounting said scraper such that said scraper engages the peripheral surface of said plug to be cleaned while maintaining the axis of the scraper horizontally; scraper driving means for rotatively driving said scraper; guiding means for guiding said truck such that said scraper is moved along the surface to be cleaned; and truck driving means adapted for driving said truck along said guiding means.

2. An apparatus for cleaning a coke oven door as claimed in claim 1, wherein said truck carries two scrapers disposed in parallel with each other for cleaning both side surfaces of said plug, said guiding means include a pair of rails extending vertically and disposed at both side portions of said frame structure opposed to each other, said truck includes at least one pair of rollers adapted to roll along said rails.

3. An apparatus for cleaning a coke oven door as claimed in claim 2, wherein said two scrapers are mounted on said truck for adjustment of distance therebetween.

4. An apparatus for cleaning a coke oven door as claimed in claim 3, further comprising; supporting means for rotatably supporting the rotary shafts of said scrapers; a horizontal guide groove provided in said truck and extending horizontally; a guide roller adapted to roll along said guide groove and attached rotatably around said rotary shaft of each scraper; a pair of hydraulic cylinders mounted on said truck; and link mechanisms through which said hydraulic cylinders are operatively connected to said supporting means for supporting said scrapers.

5. An apparatus for cleaning a coke oven door as claimed in claim 3, further comprising: supporting means for rotatably supporting said rotary shafts of said scrapers; and a pair of arms movable around respective axes parallel to the axes of rotation of said scrapers, each of said arm being pivotally secured at its one end to said truck and carrying at its other end said supporting means for supporting said scrapers; said arms being connected to each other through a hydraulic cylinder so as to be moved toward and away from each other by hydraulic cylinder.

6. An apparatus for cleaning a coke oven door as claimed in claim 1, further comprising a pair of supporting frames extending forwardly from both side portions of said main frame structure in parallel and outwardly spaced relationship with said scraper, said supporting frame includes a door holding means mounted for movement in parallel with said scraper and provided with at least a pair of hooks.

7. An apparatus for cleaning a coke oven door as claimed in claim 6, wherein at least one of said supporting frames is swingable outwardly around its rear end.

8. An apparatus for cleaning a coke oven door as claimed in claim 1, further comprising a secondary scraper provided on said main frame structure for free movement in the axial direction of said first-mentioned scraper keeping a sliding engagement with the spiral groove of said first scraper in accordance with the rotation of said first scraper.

9. An apparatus for cleaning a coke oven door as claimed in claim 8, further comprising a slider to which said second scraper is attached and movable along a guide extending in parallel with the axis of said first scraper, stoppers adapted to be engaged by said slider at respective stroke ends of said slider and displaceable in the axial direction, and means adapted to urge said stoppers toward each other.

10. An apparatus for cleaning a coke oven door as claimed in claim 8 or 9, wherein said secondary scraper incorporates a heat generating body.

* * * * *